US006637813B2

(12) United States Patent
Wiecek

(10) Patent No.: US 6,637,813 B2
(45) Date of Patent: Oct. 28, 2003

(54) RECLINING MECHANISM AND FURNITURE ITEM HAVING PUSHER MECHANISM

(75) Inventor: Glenn N. Wiecek, Shelbyville, KY (US)

(73) Assignee: L&P Property Management Company, South Gate, CA (US)

( * ) Notice: Subject to any disclaimer, the term of this patent is extended or adjusted under 35 U.S.C. 154(b) by 68 days.

(21) Appl. No.: 09/961,005

(22) Filed: Sep. 21, 2001

(65) Prior Publication Data

US 2002/0043823 A1 Apr. 18, 2002

Related U.S. Application Data

(63) Continuation-in-part of application No. 09/850,463, filed on May 7, 2001, now Pat. No. 6,557,934, which is a continuation-in-part of application No. 09/298,334, filed on Apr. 23, 1999, now Pat. No. 6,231,120.

(51) Int. Cl.[7] ..... A47C 1/02
(52) U.S. Cl. ..... 297/84
(58) Field of Search ..... 297/84, 85, 83, 297/68, DIG. 7, 259.2, 423.2, 423.1, 423.19

(56) References Cited

U.S. PATENT DOCUMENTS

| | | | |
|---|---|---|---|
| 276,687 | A | 5/1883 | Hartley |
| 649,383 | A | 5/1900 | Wilcke |
| 2,169,550 | A | 8/1939 | Arends |
| 2,879,833 | A | 3/1959 | Fletcher |
| 3,012,816 | A | 12/1961 | Lorenz et al. |
| 3,039,814 | A | 6/1962 | Schliephacke |
| 3,794,381 | A | 2/1974 | Caldemeyer |
| 3,869,169 | A | 3/1975 | Johnson et al. |
| 4,226,468 | A | 10/1980 | Johnson |
| 4,357,049 | A | 11/1982 | Rogers, Jr. et al. |
| 4,506,925 | A | 3/1985 | Crum |
| 4,531,778 | A | 7/1985 | Rogers, Jr. |
| 4,577,902 | A | 3/1986 | Crum |
| 4,715,654 | A | 12/1987 | Laskowitz |
| 4,844,536 | A | 7/1989 | Mizelle |
| 4,895,411 | A | 1/1990 | Pine |
| 4,904,019 | A | 2/1990 | May |
| 5,007,679 | A | 4/1991 | Mizelle |
| 5,013,084 | A | 5/1991 | May |
| 5,141,284 | A | 8/1992 | LaPointe |
| 5,368,366 | A | 11/1994 | Mizelle |
| 5,388,886 | A | 2/1995 | LaPointe et al. |
| 5,480,209 | A | 1/1996 | May |
| 5,582,457 | A | 12/1996 | Komorowski et al. |
| 5,653,498 | A | 8/1997 | Grandfield |

FOREIGN PATENT DOCUMENTS

| | | | |
|---|---|---|---|
| DE | 29707730 | U | 7/1997 |
| EP | 0680713 | A | 11/1995 |

*Primary Examiner*—Milton Nelson, Jr.
(74) *Attorney, Agent, or Firm*—Wood, Herron & Evans, L.L.P.

(57) ABSTRACT

A reclining mechanism for a furniture item includes support structure adapted for attachment to the furniture item, a footrest support bar connected for longitudinal movement with respect to the support structure between extended and retracted positions and actuating structure connected with the footrest support bar. The footrest support bar includes an S-shaped section and is connected to a footrest member for supporting the legs of the seat occupant. The actuating structure moves the footrest support bar along the S-shaped section between the extended and retracted positions.

26 Claims, 11 Drawing Sheets

RECLINING MECHANISM AND FURNITURE ITEM HAVING PUSHER MECHANISM

CROSS REFERENCE TO RELATED APPLICATIONS

This application is a continuation-in-part application of U.S. patent application Ser. No. 09/850,463 filed May 7, 2001, now U.S. Pat. No. 6,557,934 the disclosure of which is fully incorporated by reference herein. U.S. patent application Ser. No. 09/850,463 is a continuation-in-part application of U.S. patent application Ser. No. 09/298,334 filed Apr. 23, 1999, now U.S. Pat. No. 6,231,120, the disclosure of which is fully incorporated by reference herein.

FIELD OF THE INVENTION

This invention generally relates to reclining furniture and, more specifically, to a three-way reclining furniture item having a movable seat, backrest and footrest.

BACKGROUND OF THE INVENTION

Conventional reclining furniture items, such as chairs, sofas and sectionals, generally have either two-way or three-way mechanisms for allowing the chair to be moved between upright and reclined positions. In a two-way mechanism, the seat is fixed to the backrest as a unitary structure so that the angle between the seat and backrest remains the same during reclining motion. If the piece of furniture has a three-way mechanism, the top of the backrest will angle downwardly and rearwardly relative to the seat as the furniture item moves from an intermediate reclined or so-called T.V. position to a fully reclined position. Likewise, the backrest will move or tilt back up as the furniture item moves from the fully reclined position to the T.V. position. Among the concerns with reclining mechanisms in general are complexity and cost issues. These mechanisms can comprise large numbers of linkages and pivots to give the desired movement to the furniture item. Understandably, the more linkages and pivot connections in a given reclining mechanism, the higher the cost of manufacture and assembly. It has also become conventional practice to design reclining mechanisms with "zero wall proximity" ability. This refers to the ability to place the item of furniture with the top of the backrest against or very close to a wall while still allowing movement of the furniture item into both intermediate and fully reclined positions without encountering interference from the wall. Generally, the addition of this feature to a mechanism has even further complicated the typical three-way reclining mechanism. Another problem associated with reclining mechanisms has been the noise that they produce in moving between the different chair positions. Again, this noise can be associated with the numerous moving linkages in the mechanisms.

There have been many attempts to incorporate rollers in reclining mechanisms in various ways to produce mechanisms allowing different movements. For example, see U.S. Pat. Nos. 3,874,724; 4,072,342; 4,364,603; 4,531,778; and 5,823,614. One area of improvement that would be desirable relates to the footrest linkage of the mechanism. Conventionally, a scissor linkage assembly has been incorporated to extend and retract the footrest. Consumers have become widely familiar and comfortable with the typical footrest movement between the retracted and extended positions. However, the linkage assemblies have high numbers of links and pivots and present exposed pinch points. Certain consumers may also find them unattractive when in the extended position.

Alternative designs have been proposed to simplify the typical footrest scissor linkage, however, none of these alternatives have been fully acceptable. For example, alternative footrest mechanism constructions are shown in U.S. Pat. Nos. 4,506,925 and 4,844,536. In general, the mechanisms shown in these patents substitute bars which carry a footrest between retracted and extended positions using linkages, rollers or both. One major drawback with previous proposals such as these is that the resulting movement of the footrest does not closely approximate the typical movement of a footrest as refined through years of reclining mechanism development. This is believed to be one reason that these alternative footrest constructions have not been accepted in the industry.

In view of various problems with reclining mechanisms, such as three-way reclining mechanisms, it would be desirable to simplify these mechanisms and make them more attractive by significantly reducing the number of linkages in the footrest support and actuation portion, while also reducing costs, noise and potential pinch points associated with the mechanisms. At the same time, it would advantageous to provide a mechanism which fully reclines in a smooth manner without significant effort by the seat occupant and without interfering with a closely adjacent wall located behind the backrest.

SUMMARY OF INVENTION

The present invention improves upon past reclining mechanisms by incorporating a simplified footrest support bar and actuating system that closely approximates the typical arc-shaped movement of an extending and retracting footrest mechanism. In the preferred embodiment, a reclining mechanism is provided for a furniture item to allow movement between upright and reclined positions. More specifically, this may include one upright position and two reclined positions, typically referred to as an intermediate reclined position or T.V. position and a fully reclined position. The reclining mechanism generally includes support structure adapted for attachment to the furniture item, and a footrest support bar connected for longitudinal movement with respect to the support structure between extended and retracted positions. In the preferred embodiment, the support structure includes a track and the footrest support bar is connected for movement along the track. At least one of the track and the footrest support bar includes an S-shaped section. A first end of the footrest support bar is adapted for connection to a footrest member for supporting the legs of a seat occupant. Actuating structure is provided and connected with the footrest support bar and operates to move the footrest support bar along the S-shaped section between the extended and retracted positions.

In one advantageous and preferred configuration, the S-shaped section is on the footrest support bar. The S-shaped section of the footrest support bar functions to closely approximate the movement of a conventional footrest mechanism. Also, in furtherance of this advantage, the footrest support bar includes at least one roller attached for rotation thereto and the support structure further includes a track. The roller is mounted for movement along the track between the extended and retracted positions. In the preferred embodiment, the track includes at least one curved section between the first and second ends and, more preferably, the entire track curves upward and then downward from a rear portion to a front portion thereof.

While the support structure may take many forms, it preferably includes a seat supporting member mounted adjacent the footrest support bar in a manner allowing the actuating structure to travel along the track as the footrest support bar moves between the extended and retracted positions. The roller is attached proximate the second end of the footrest support bar and the track includes first and second stops, which may be the ends of the track, with the roller engaging the stops at the respective upright and reclined positions. In a three-way mechanism, the rollers will preferably engage the stops at the upright and intermediate reclined positions. The roller is connected for movement with the actuating structure along the track. At least one additional roller is connected to a front portion of the support structure adjacent the footrest support bar and engages the footrest support bar during movement between the extended and retracted positions. In the preferred embodiment, upper and lower rollers are connected to the front portion of the support structure. These upper and lower rollers will support and guide the footrest support bar during movement between the extended and retracted positions. Many other options, such as a gliding option, swivel option, etc., may also be incorporated into a mechanism of the present invention.

The invention further includes at least one pusher assembly adapted to urge said footrest support bar towards an extended position from a retracted position. The pusher assembly comprises a spring-biased locking link and a spring-biased pushing link. The locking link engages the footrest support bar and maintains the footrest support bar in a retracted position until it is moved by the seat occupant. The spring-biased pushing link pushes the footrest support bar forwardly towards the extended position. The seat occupant activates the locking link by pulling a cable forwardly via an actuator, raising the locking link from engagement with the footrest support bar. The spring-biased pushing link then urges the footrest support bar forwardly. Although a cable is used to initially move the locking link, any other mechanical mechanism may be used as well.

The invention also generally contemplates a method of operating a footrest mechanism in a reclining furniture item as generally described above. The method involves maintaining the footrest in a generally vertical orientation, moving the footrest support bar simultaneously downward and outward, reorienting the footrest into an angled orientation, extending the footrest support bar through an upwardly and outward arc while the footrest moves through the angled orientation, and stopping the footrest support bar with the footrest in the generally horizontal orientation at an upper end of the arc and the footrest support bar extending between the seat and the footrest. The method further involves retracting the footrest support bar through an opposite downward and inward arc while the footrest moves through the angled orientation and moving the footrest support bar upward and inward toward the seat as the footrest approaches the seat. The footrest stops in the generally vertical orientation in a typical position tucked beneath the seat.

The invention further contemplates a reclining mechanism similar to the above-described mechanism but either alternatively or additionally including a footrest member that is connected for biased, pivotal motion with respect to the footrest actuating structure, such as the S-shaped footrest support bar. In one aspect, the footrest member is connected by at least one spring to the footrest actuating structure and the spring is mounted for movement into an over-center position for pivoting the footrest member into a leg supporting position upon extension thereof. In another aspect, the footrest member is pivotally connected to the footrest actuating structure in a pivoting, spring-biased fashion allowing pivoting motion in two directions whereby the front edge of the footrest member is pivotal downward in the leg supporting position and the rear edge of the footrest member is pivotal outward in the retracted position. This allows the footrest to float in a spring-biased fashion in concert with movement of the seat occupant's legs in the extended position. Other configurations of mounting the footrest such as are shown in applicant's U.S. Pat. No. 6,231,120 or shown in applicant's pending U.S. patent application Ser. No. 09/850,463 may be used in accordance with the present invention.

Additional features, objectives and advantages of the invention will be more readily appreciated from the description to follow, taken in conjunction with the accompanying drawings and the various configurations of the invention set forth in the appended claims.

DETAILED DESCRIPTION OF PREFERRED EMBODIMENTS

Figure 1:
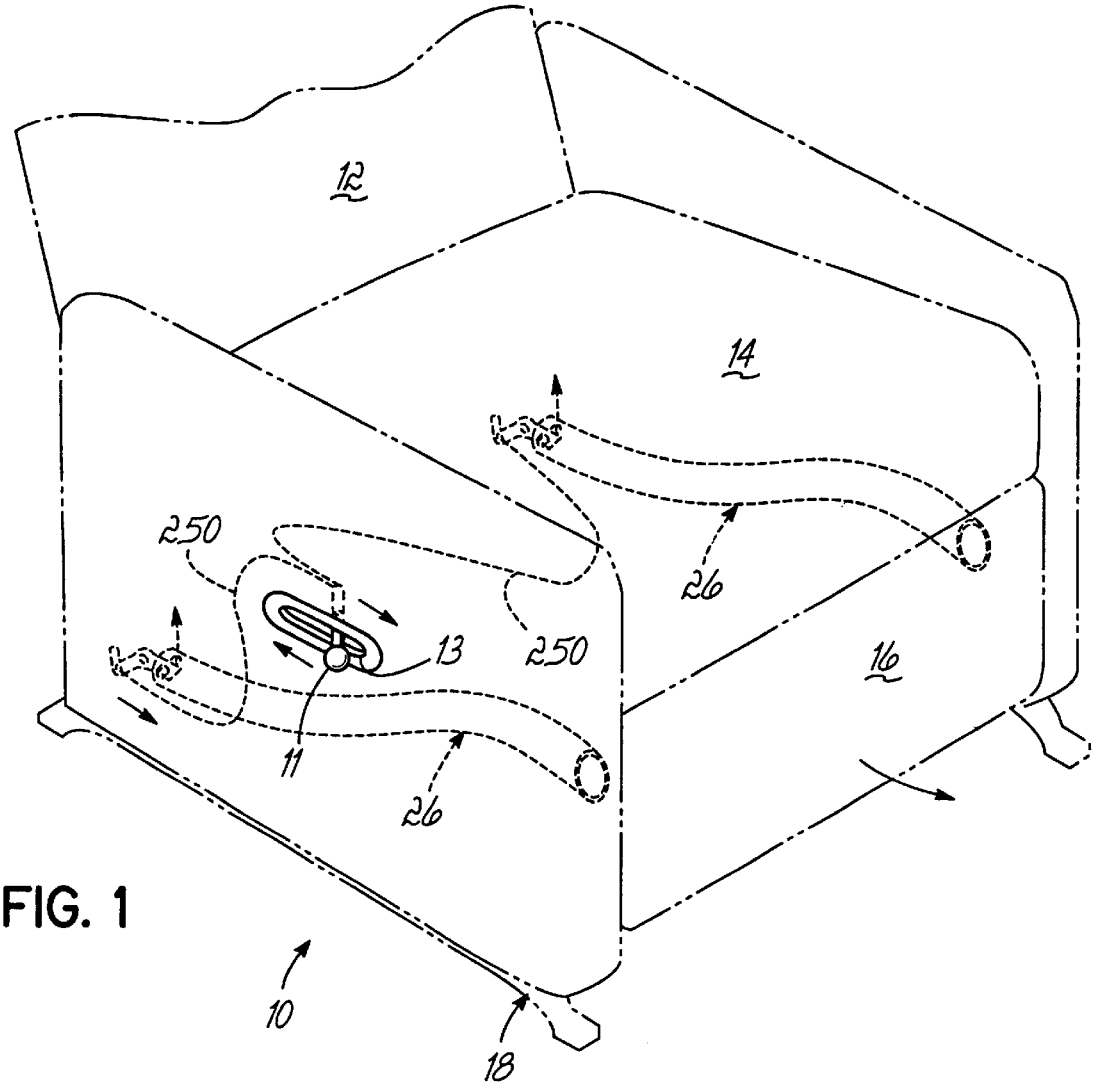
FIG. 1 is a perspective view of a schematically illustrated furniture item depicting a portion of a reclining mechanism constructed in accordance with the invention.

Referring to the drawings and particularly to FIG. 1, there is illustrated a reclining furniture item 10 constructed in accordance with the preferred embodiment including a schematically illustrated backrest 12 and seat 14. A footrest 16 is connected for extension and retraction in a manner to be described below. In this preferred embodiment, furniture item 10 is configured such that the backrest 12, seat 14 and footrest 16 move with respect to a base member 18 and by way of a reclining mechanism 20 between the fully upright position shown in FIG. 2 and respective intermediate reclined and fully reclined positions shown in FIGS. 3 and 4. It will be appreciated that many other mechanism configurations, including two-way and three-way mechanisms, may incorporate one or more features of this invention. It will also be understood that, as in the typical case, two reclining mechanisms will be used in a given item of furniture. These mechanisms will be mounted on opposite sides of seat 12 and will be mirror images of one another. Only a description of one mechanism 20 will be detailed herein with the understanding that another mirror image mechanism is connected on the opposite side of furniture item 10.

Reclining mechanism 20 includes a seat link or plate 22 connected for movement with seat 14 and backrest linkage 24 connected for movement with backrest 12. An S-shaped footrest support bar 26 has a front end portion 28. An L-shaped support bracket 34 affixed to footrest 16 is pivotally secured at 32 to the front end portion 28 of the footrest support bar 26. A second, opposite end of the S-shaped footrest support bar 26 includes a roller 36 connected for rotation therewith. See FIGS. 5–7. Roller 36 is contained on a track which is preferably configured as a slot 38 contained within seat link 22. S-shaped footrest support bar 26 is further supported and guided at a front end of seat link 22 by upper and lower rollers 40, 42. These rollers engage footrest support bar 26 as it moves between retracted and extended positions as explained further below. The diameter of the lower roller 42 is larger than the diameter of the upper roller 40 to reduce the number of revolutions of the lower roller 42 and hence reduce the noise created thereby. In one preferred embodiment, the diameter of the lower roller 42 is three inches; however it may be any diameter.

Figure 2:
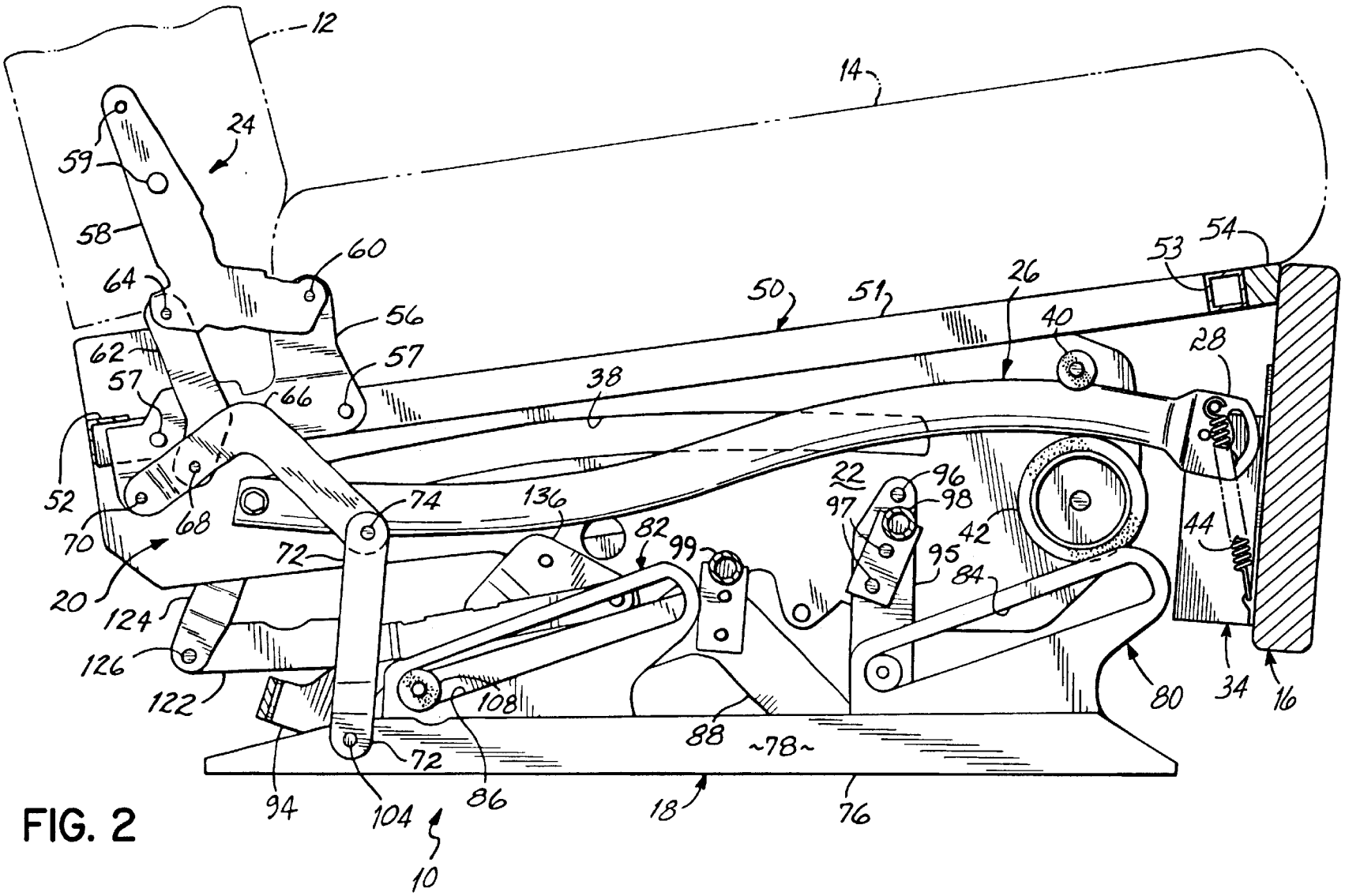
FIG. 2 is an elevational view of a schematically illustrated furniture item depicting a reclining mechanism constructed in accordance with the invention and shown from an inside perspective.
Figure 3:
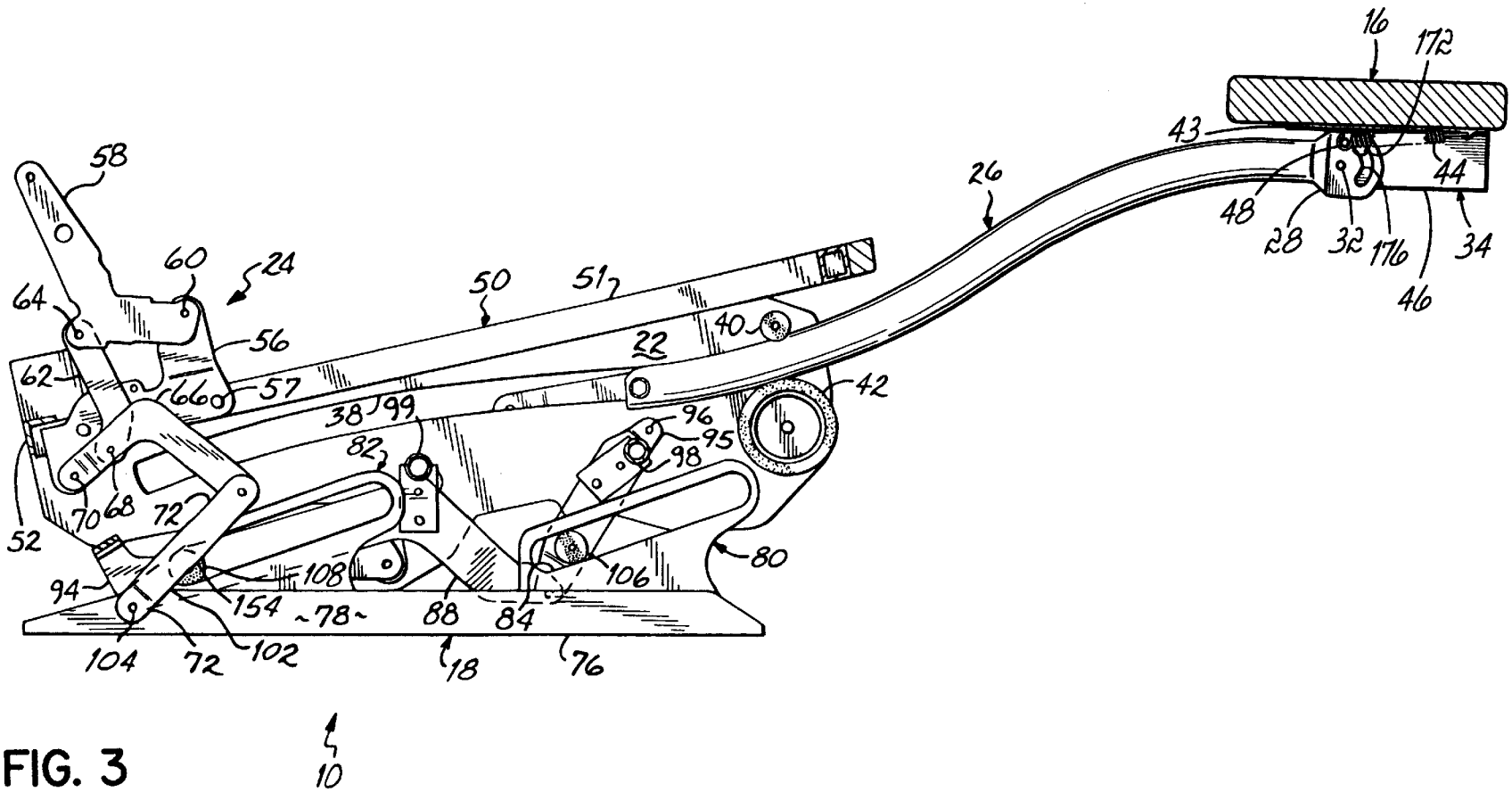
FIG. 3 is a cross-sectional view of the reclining mechanism shown in FIG. 1, but illustrated in the intermediate reclined or T.V. position.
Figure 4:
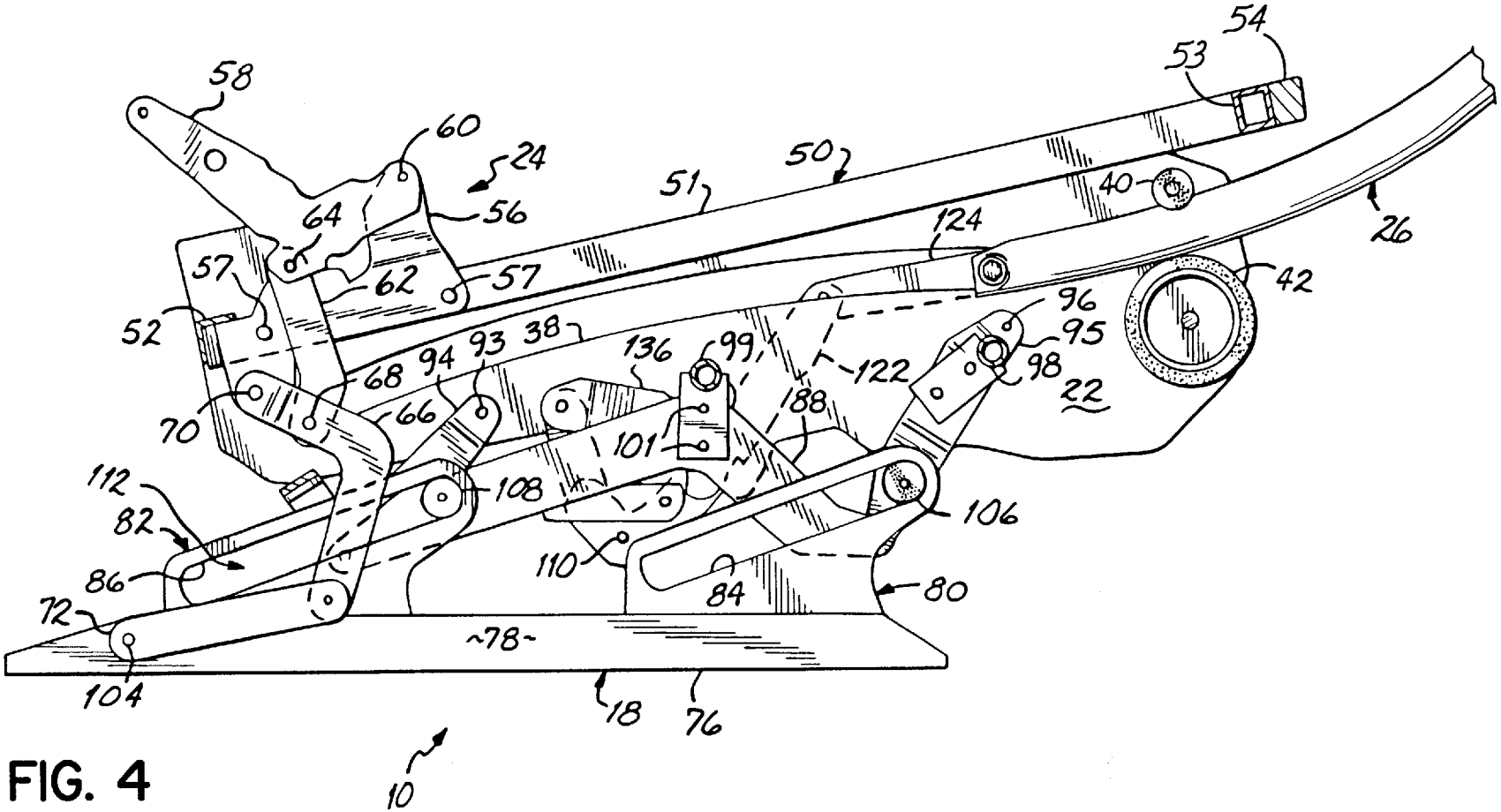
FIG. 4 is a fragmented cross-sectional view similar to FIG. 3, but showing the mechanism in a fully reclined position.

As best illustrated in FIGS. 2 and 3, a generally rectangular seat supporting structure 50 comprises a pair of side portions 51, a rear portion 52 and a front portion 53. A stop 54 is secured to the front portion 53 of the seat supporting tube structure 50.

Referring to FIG. 1, backrest linkage 24 includes a link 56 rigidly secured by fasteners 57 to the side portion 51 of the seat supporting structure 50. A pivoting backrest link 58 is rigidly affixed to backrest 12 by fasteners 59 and includes a pivot 60 at one end secured to link 56. Another link 62 has one end pivotally secured to backrest link 56 at a pivot connection 64 and has an opposite, lower end connected with a link 66 at a pivot connection 68. Link 66 is generally L-shaped and includes a pivot connection 70 with link 56. A lower end of link 66 is connected with a further link 72 at a pivot connection 74. Link 72 is pivotally secured at 104 to the base member 18.

Figure 5:
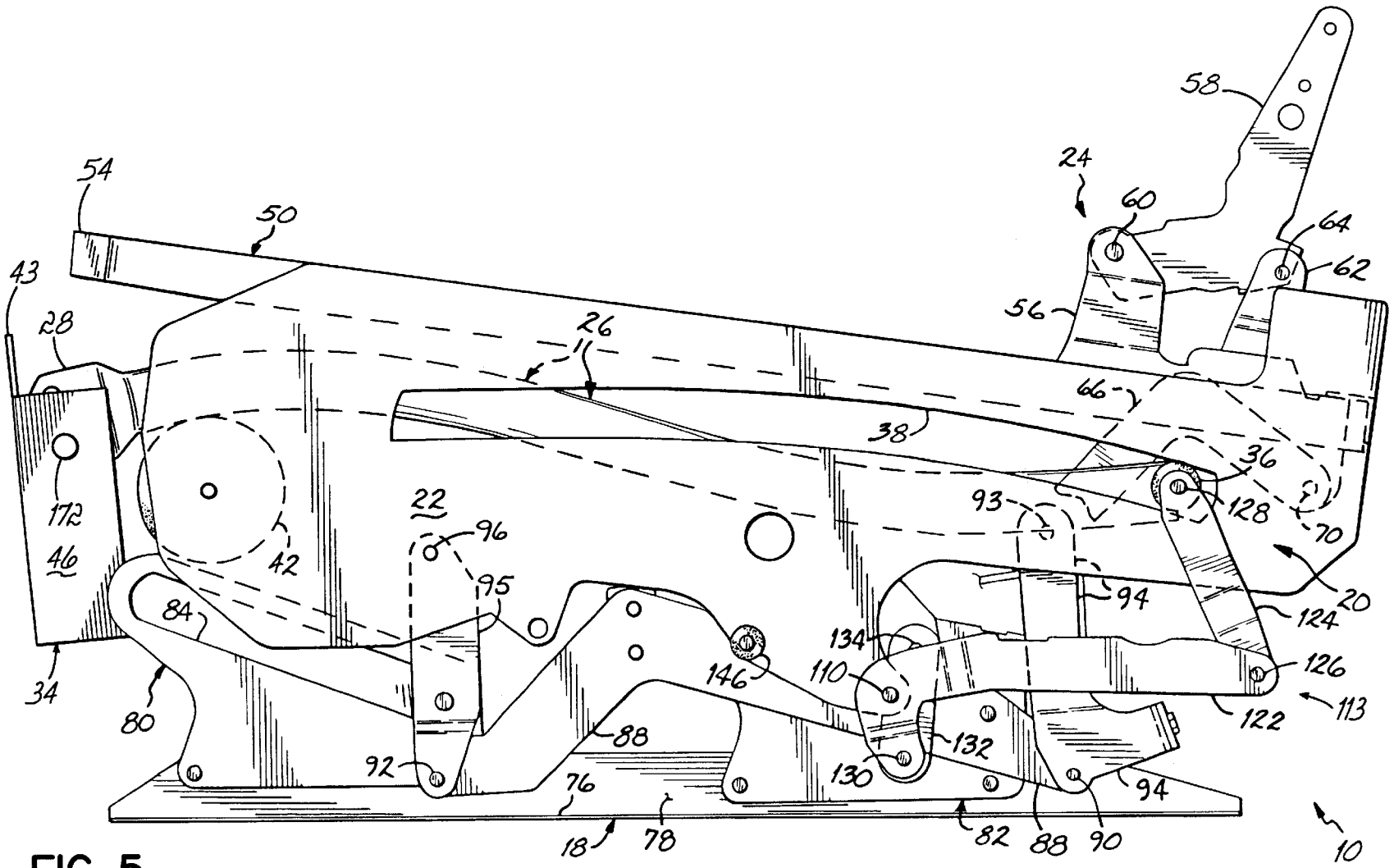
FIG. 5 is a cross-sectional view similar to FIG. 2, but deleting the schematically illustrated seat and backrest for clarity and showing the reclining mechanism from an outside perspective.

As best illustrated in FIG. 5, base member 18 comprises a horizontally oriented first portion 76 adapted to engage the floor or supporting surface and a vertically oriented second portion 78 extending upwardly from the first portion 76 of the base member 18. Thus, the base member 18 has a generally L-shaped cross sectional configuration. Although one configuration of base member 18 is illustrated and described, other configurations may be utilized in accordance with the present invention.

As seen in FIG. 2, spaced front and rear slotted brackets 80, 82, respectively, are secured to the vertically oriented second portion 78 of the base member 18. The front bracket 80 has a front track or slot 84 and the rear bracket 82 has a rear track or slot 86 contained therein.

Also illustrated in FIG. 5, another link 94 is connected at its upper end at pivot connection 93 to an inside surface of seat plate 22. The lower end of link 94 is pivotally secured to a base plate or link 88 at a pivot connection 90. At its forward end, base plate or link 88 is pivotally secured at 92 to another link 95. Link 95 is pivotally secured at pivot connection 96 to an inside surface of seat plate 22. As best illustrated in FIG. 2, a first cross bar 98 is secured to link 95 with fasteners 97. The cross bar 98 extends transversely from one reclining mechanism 20 to the other reclining mechanism. A second cross bar 99 likewise extends transversely from one reclining mechanism 20 to the other. The second cross bar 99 is secured to base plate 88 with fasteners 101. See FIG. 2A.

Forward and rearward movement of seat 14 with respect to base member 18 is provided by front and rear rollers 106, 108 riding in respective front and rear tracks or slots 84, 86 contained in front and rear brackets 80, 82 respectively. As will be discussed below, this movement takes place between the T.V. or intermediate reclined position and the fully reclined position. It will be appreciated that rear roller 108 also moves independently of front roller 106 when the reclining mechanism 20 goes from the fully upright or closed position (FIG. 2) to the T.V. or intermediate reclined position (FIG. 3). As best illustrated in FIG. 2, rear roller 108 is connected to base link 88, while front roller 106 is connected to link 95.

Figure 6:
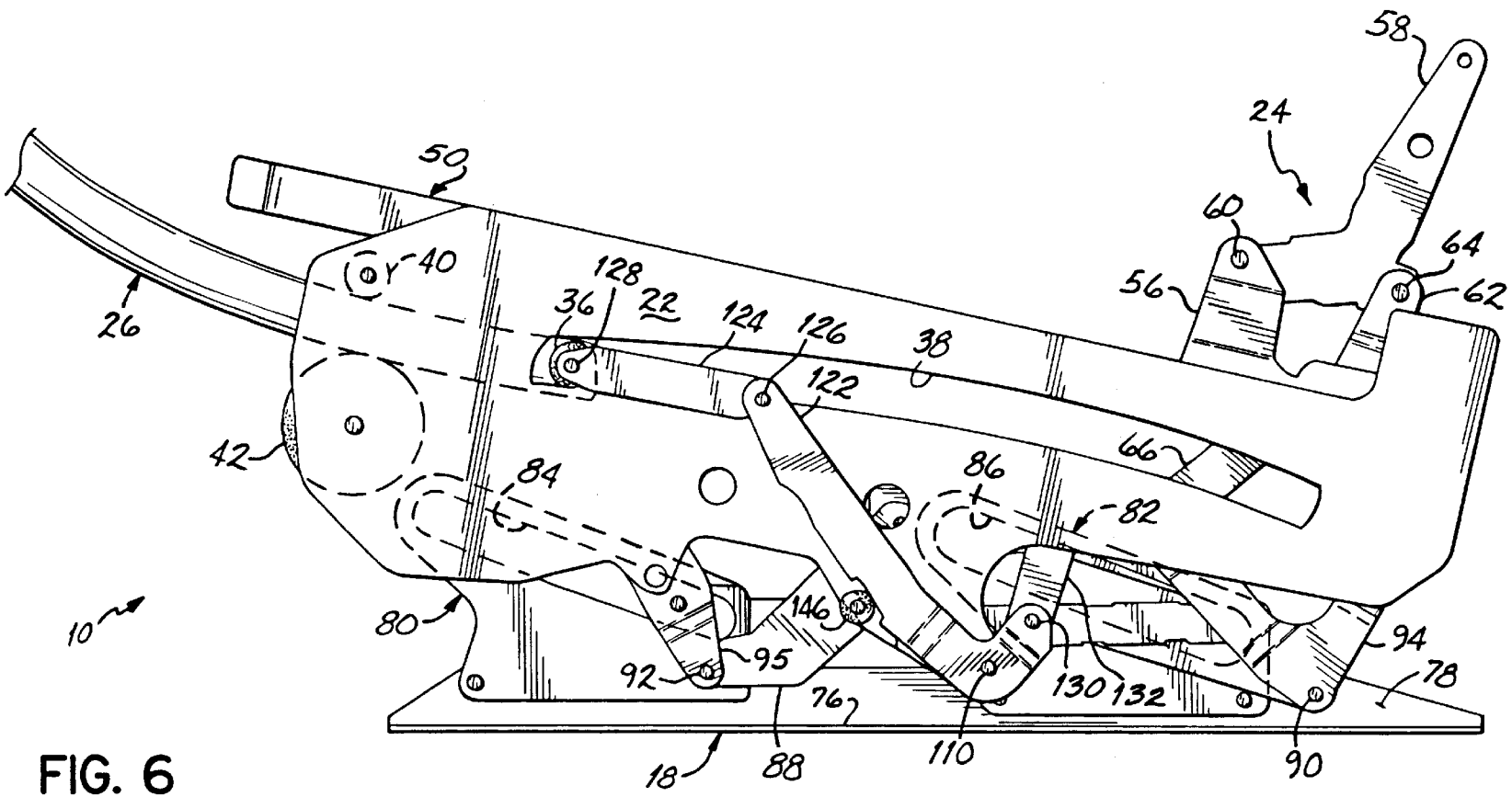
FIG. 6 is a fragmented cross-sectional view similar to FIG. 5, but showing the mechanism in the intermediate reclined or T.V. position.
Figure 7:
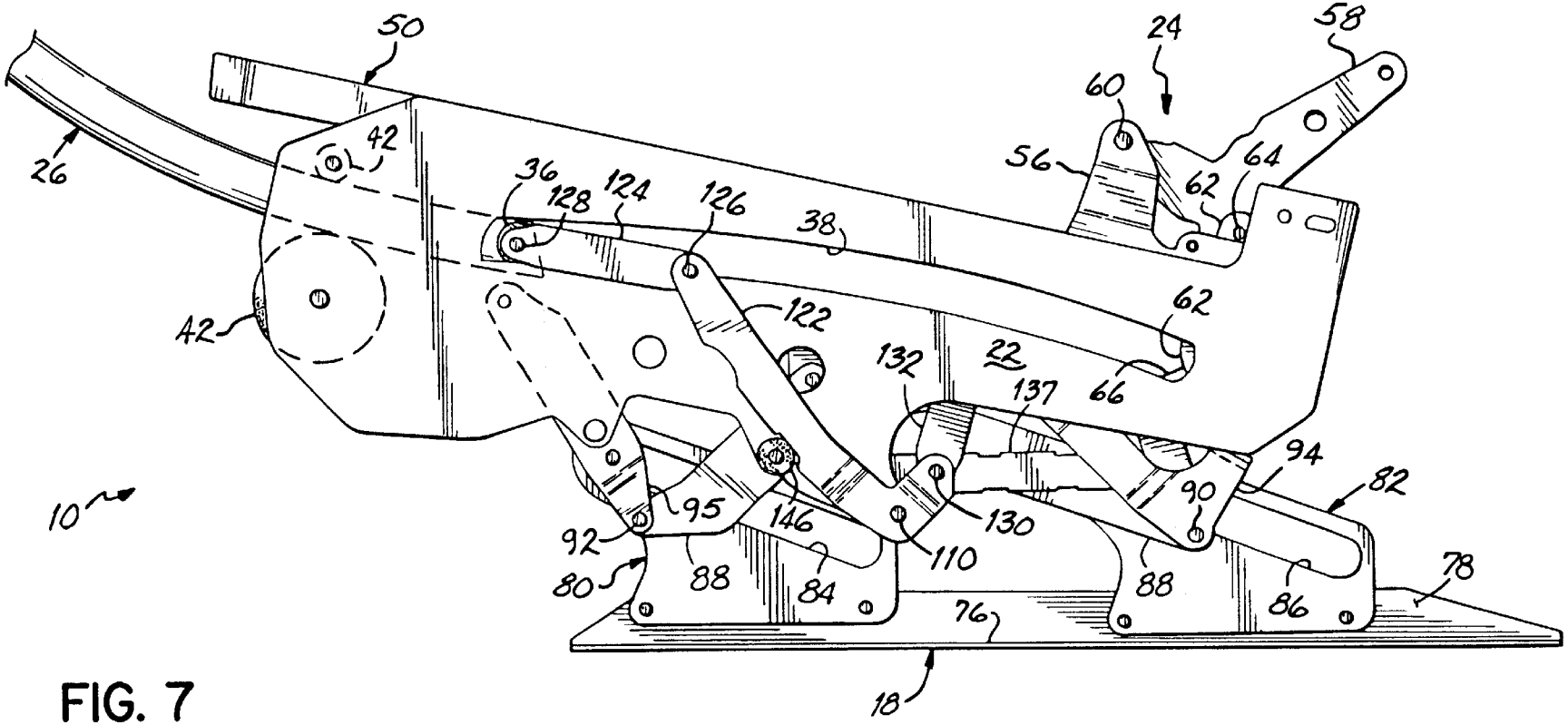
FIG. 7 is a fragmented cross-sectional view similar to FIG. 6, but showing the reclining mechanism in a fully reclined position.

FIGS. 5–7 respectively illustrate the fully upright, intermediate reclined or T.V. and fully reclined positions of mechanism 20 from an outside or elevational view. This better illustrates the actuating structure 113 for extending the footrest 16. Actuating structure 113 preferably comprises links 122 and 124 connected for movement upon activation of a pusher assembly 200 which is activated by a seat occupant. Drive link 122 is secured to secondary drive link 124 at pivot connection 126. Secondary drive link 124 is secured at its opposite end to S-shaped footrest support bar 26 through roller 36 at pivot connection 128.

Figure 2A:
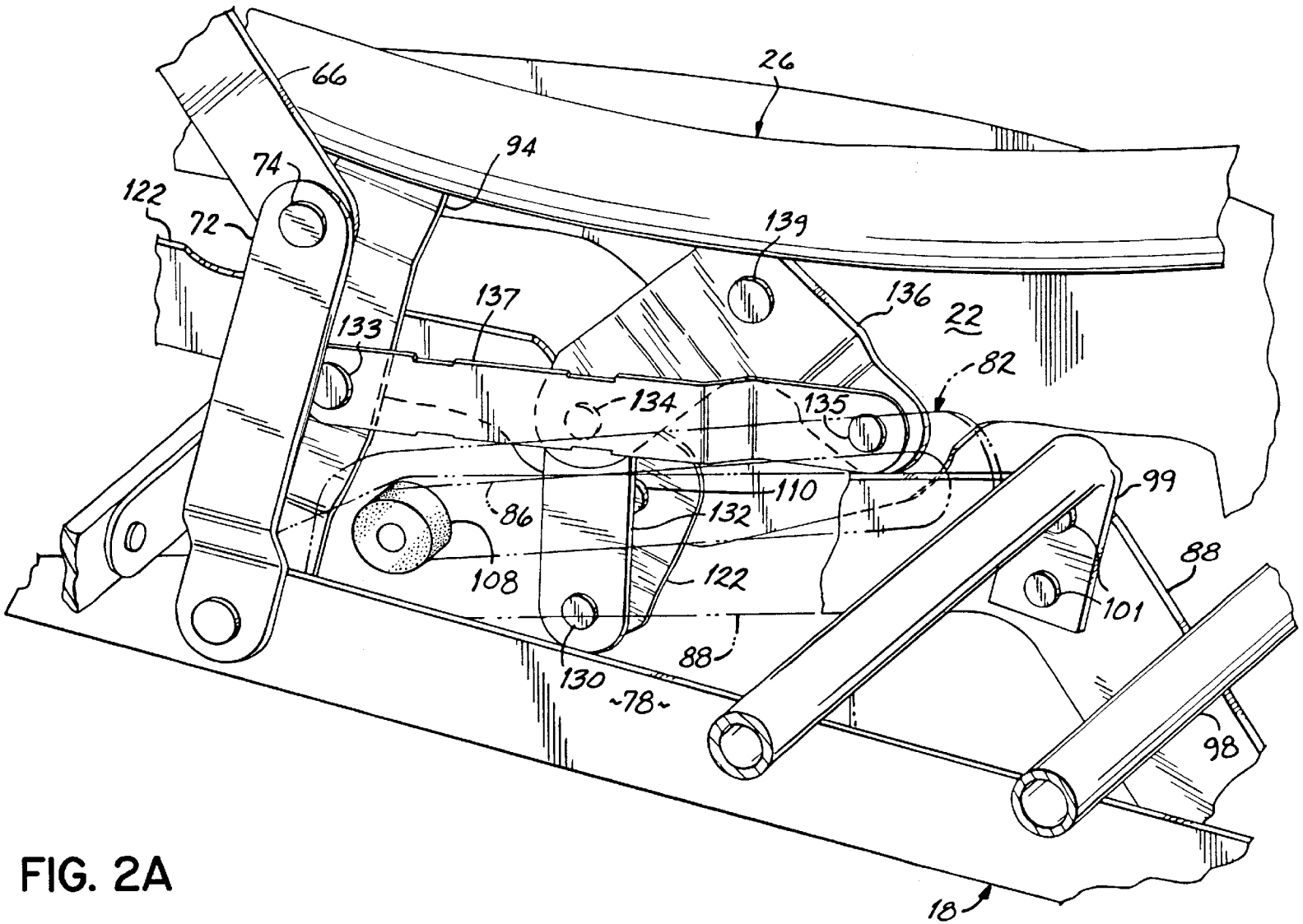
FIG. 2A is a perspective view of a portion of the reclining mechanism shown from an inside perspective.

The other end of drive link 122 rotates about a pivot connection 130 to another link 132. At pivot point 110, the drive link 122 is secured to the seat link 22. As illustrated in FIG. 2A, an upper end of link 132 is secured to one end of V-shaped link 136 at 134. The other end of the V-shaped link 136 is secured to link 137 at pivot connection 135. The apex of V-shaped link 136 is secured at 139 to the seat plate/link 22. The opposite end of link 137 is secured at pivot connection 133 to the inside surface of link 94.

During movement from the fully upright position shown in FIGS. 2 and 5 to the T.V. position shown in FIGS. 3 and 6, the seat occupant leans rearwardly on the backrest 12, causing movement of the actuating structure 113. More specifically, as seen in FIG. 1, the seat occupant pulls rearwardly on handle 11 projecting through a slot 13 in the side of the furniture item 10, thereby activating pusher assembly 200 in a manner to be described in more detail below. The pusher assembly 200 causes the actuating structure 113 to actuate, thereby rotating drive link 122 about pivot point 110.

During movement from the fully upright position shown in FIG. 2 to the T.V. position shown in FIG. 3, the drive link 122 rotates until it abuts a stop 146 which extends outwardly from the seat link or plate 22. As shown in FIG. 6, the stop 146 stops the rotation of the drive link 122.

Figure 8A:
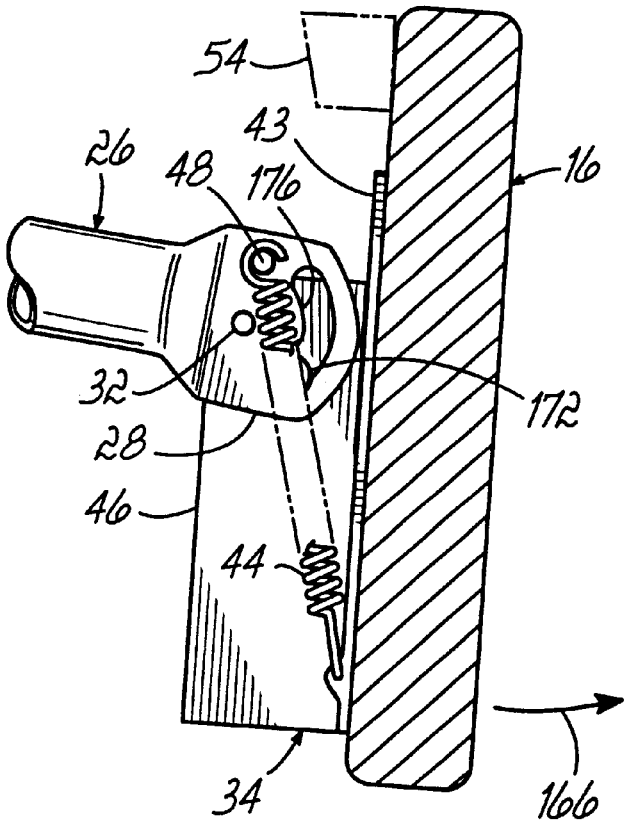
FIGS. 8A and 8B are enlarged views of the footrest member showing the various positions and pivotal motions thereof.
Figure 8B:
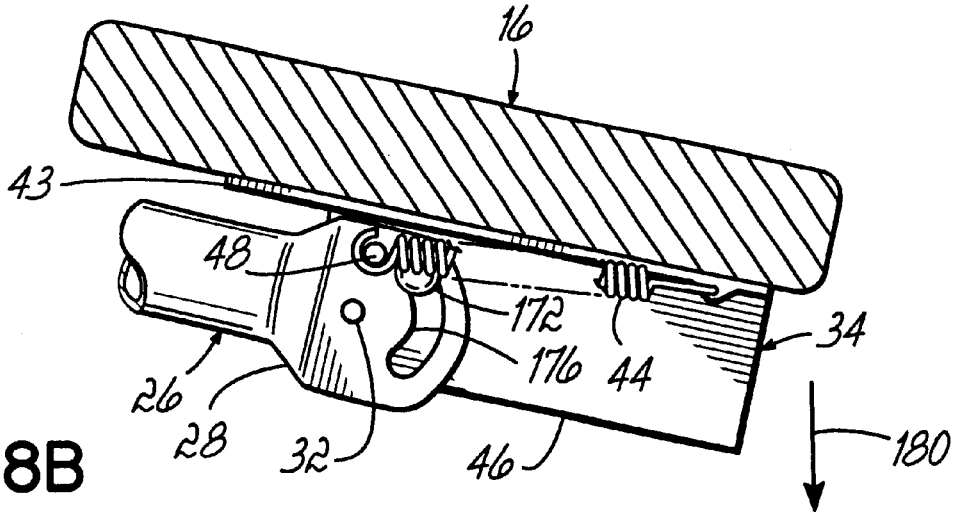

FIGS. 8A and 8B illustrate the mounting and various possible movements of footrest 16 at the end of footrest support bar 26. Bracket 34 has a generally planar first portion 43 secured to the underside of footrest 16 and a generally planar second portion 46 extending downwardly therefrom. A spring 44 is connected to the first portion 43 of bracket 34 and further connected to a stud 48 extending from the end portion 28 of footrest support bar 26. Spring 44 is disposed above pivot 32 between bracket 34 and support bar 26 in essentially an on-center position when footrest 16 is in a retracted position. Spring 44 moves to an over-center position under the weight of a seat occupant's legs as footrest 16 moves to the extended position as shown in FIGS. 2 and 8C. Once in this position, footrest 16 can float in accordance with leg movement of the seat occupant in a manner described below.

Footrest 16 is mounted on a support bracket 34 connected for pivotal movement on the end of support bar 26 by way of pivot 32. As shown in FIG. 8A, with footrest 16 in the retracted position, spring 44 is essentially on-center with pivot 32. As footrest 16 is extended in the direction of arrow 166, spring 44 moves to an over-center position as shown in FIG. 8B thereby automatically flipping footrest 16 into a horizontal leg supporting position.

As further shown in FIGS. 8A–8C, a stud 172 extends outwardly of the second portion 46 of bracket 34 and engages a groove 176 formed in the end portion 28 of the footrest support bar 26.

Referring to FIG. 8B, the engagement of the stud 172 and the groove 176 allows downward movement of the footrest 16 in the direction of arrow 180 when footrest 16 is in the extended, horizontally oriented position. The footrest 16 rotates about pivot point 32, the stud 172 traveling in the groove 176.

Operating furniture item 10 to move between three different positions will be understood generally with reference to FIGS. 2–7. In the fully upright position shown in FIGS. 2 and 5, footrest 16 is maintained in a generally vertical orientation as shown in FIG. 8A. To move furniture item 10 to the intermediate reclined or T.V. position shown in FIGS. 3 and 6, the seat occupant activates the pusher assembly 200 illustrated in FIGS. 9A and 9B which causes movement of the actuating structure 113.

As further shown in FIG. 6, the above-described movement of actuating structure 113 extends footrest support bar 26 and footrest 16 as best shown in FIG. 3. Footrest 16 initially moves downward and then moves in an upward arc to the extended position. During extension, footrest 16 is also pivoted about pivot connection 32 to the generally horizontal orientation shown in FIG. 2. This occurs by the over-center spring action discussed in connection with FIGS. 8A and 8B. During the extension of footrest support bar 26, the S-shape of bar 26 in concert with the shape of slot 38 imparts a natural and comfortable movement to footrest 16 between the retracted and extended positions. To further move mechanism 20 into the fully reclined position shown in FIGS. 4 and 7, the seat occupant applies reward pressure against backrest 12 (FIG. 1) thereby pivoting backrest link 58 as shown in FIG. 3. Through the backrest linkage 24 and the connection with base link 88 provided through link 72, this forces seat link plate 22 and the attached link 94 and rollers 106, 108 to move in a forward direction. Rollers 106, 108 travel up tracks 84, 86. The full reclining movement is stopped when rollers 106, 108 reach the ends of respective tracks 84, 86. To move back into the intermediate reclined or T.V. position, the seat occupant releases their weight from backrest 12 and, pushes the footrest 16 downwardly, thereby retracting the reclining mechanism 20. Further retraction of the reclining mechanism moves the furniture item 10 into the fully upright position. This reverses the arc-shaped extension motion of footrest 16. Also, toward the end of its retraction, footrest 16 will move briefly upward to tuck underneath seat 14 in a generally vertical orientation.

Figure 9A:
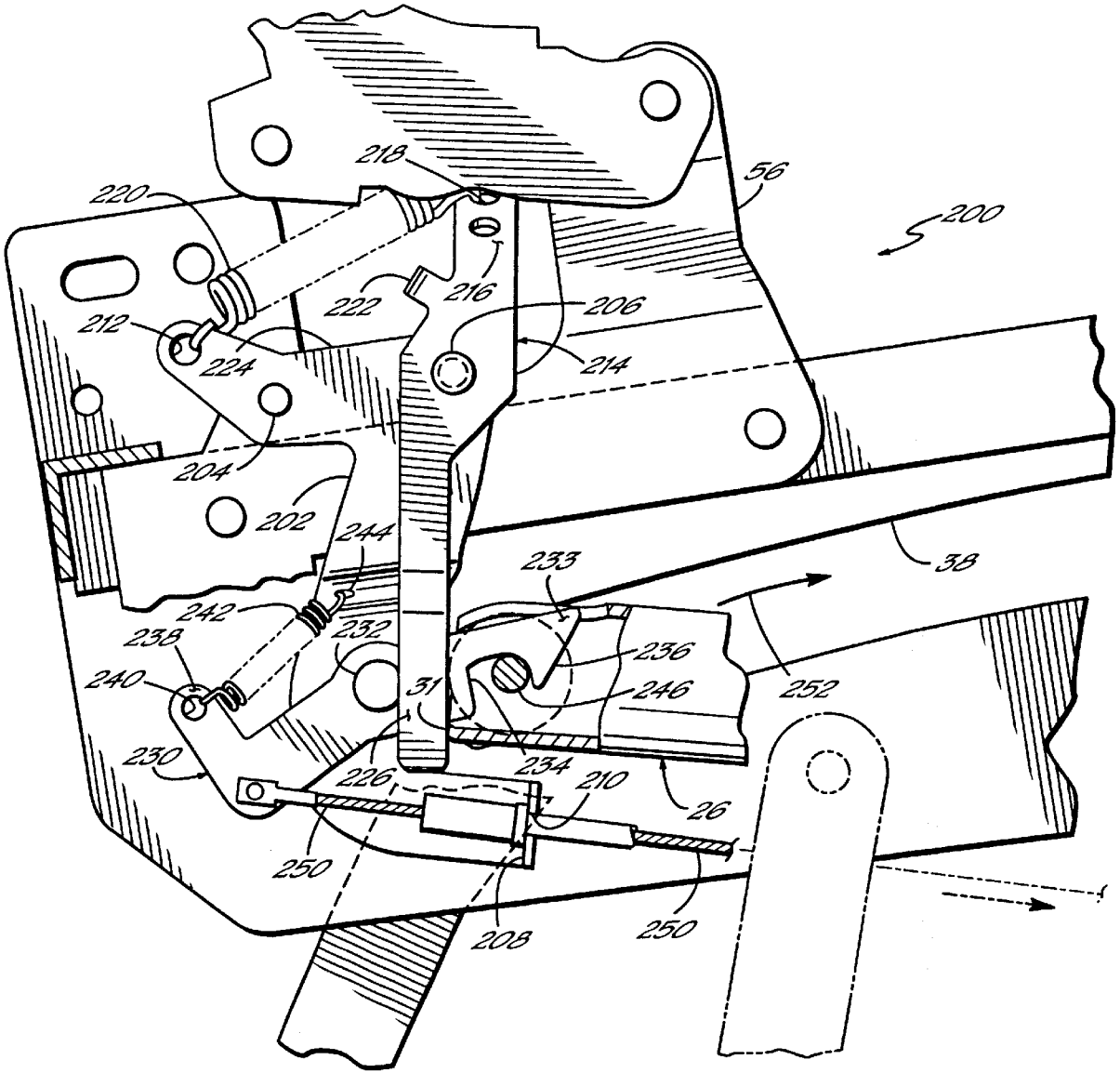
FIG. 9A is a partial cross-sectional view of the pusher assembly in a first position, the locking link of the pusher assembly locking the footrest support bar in a retracted position.
Figure 9B:
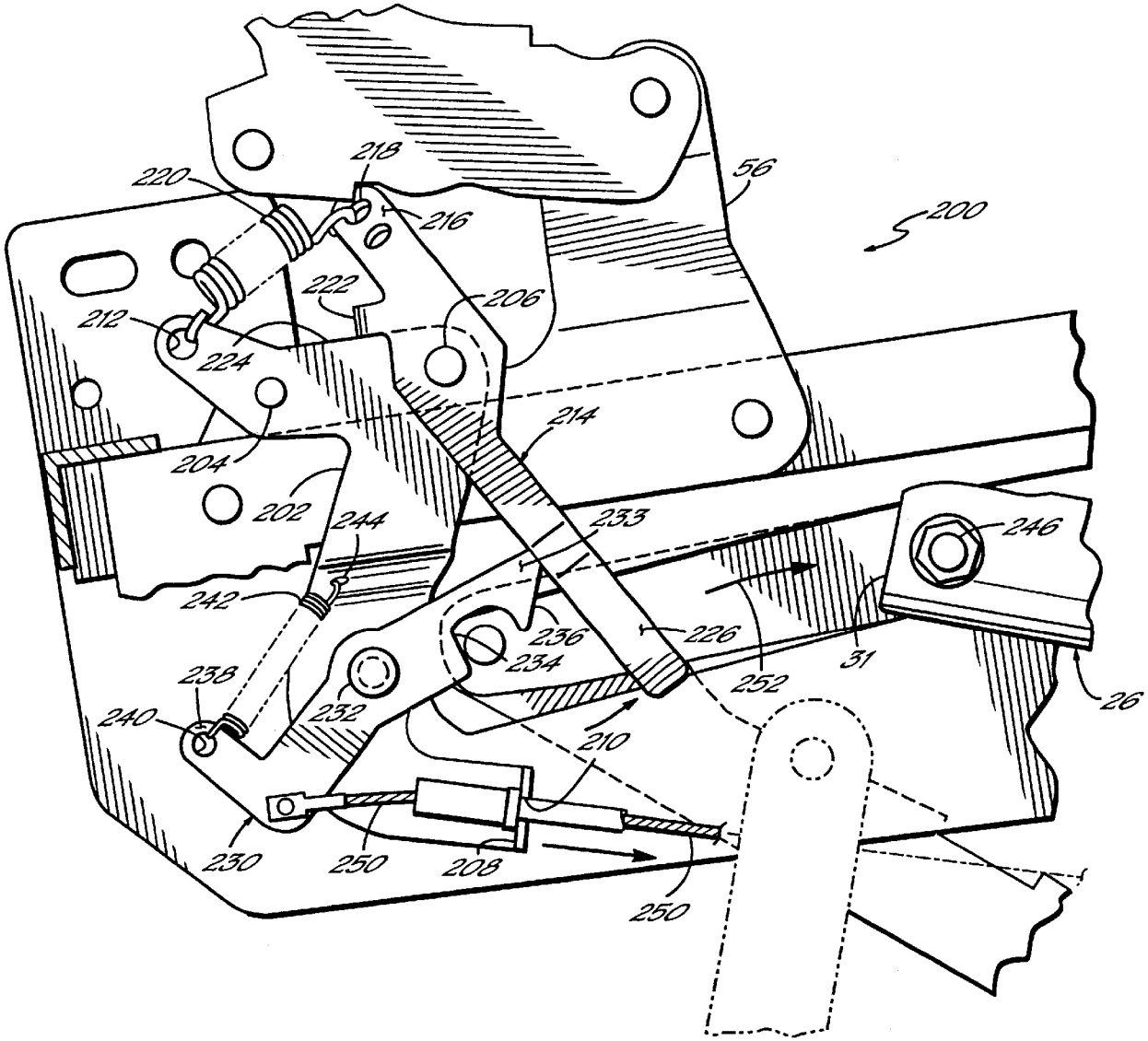
FIG. 9B is a partial cross-sectional view of the pusher assembly in a second position, the footrest support bar moving forwardly towards an extended position.

Referring to FIGS. 9A and 9B, in one embodiment of the present invention, a pusher assembly 200 is used to initially urge the footrest support bar 26 toward its extended position from its retracted position. As best illustrated in FIGS. 9A and 9B, the pusher assembly 200 comprises a generally S-shaped guiding link 202 which is fixedly secured to the link 56 (see FIG. 2) at 204 and 206. This guiding link 202 is fixedly secured to link 56 and does not move during operation of the reclining mechanism 20. At one end of the guiding link 202, a lip 208 has a groove 210 cut out therefrom. At the other end of the guiding link 202 a hole 212 is located.

Another component of the pushing assembly 200 is a pushing link 214 which is pivotably secured at 206 to the guiding link 202. An upper end or portion 216 of the pushing link 214 has at least one hole 218 formed therein which is adapted to receive one end of a first spring 220. The other end of the first spring 220 is secured to hole 212 formed in the guiding link 202. The pushing link 214 has a stop 222 integrally formed therein adapted to contact an upper edge 224 of the guiding link 202. A lower end or portion 226 of the pushing link 214 is adapted to abut the rear end 31 of the S-shaped footrest support bar 26.

As illustrated in FIGS. 9A and 9B, the first spring 220 extends between the hole 218 formed in the upper end 216 of the pushing link 214 and hole 212 formed in the guiding link 202. This first spring 220 biases the upper end 216 of the pushing link 214 counterclockwise, as illustrated in FIGS. 9A and 9B about pivot connection 206. The biasing force exerted by this spring urges the lower end 226 of the pushing link 214 against the rear end 31 of the footrest support bar 26, urging it forwardly.

A locking link 230 is pivotally secured at 232 to the guiding link 202. The locking link 230 has a cut-out portion or recess 234, thereby forming an inherent hook 236 at the front of the cut-out portion 234. A rear end 238 of the locking link 230 has at least one hole 240 formed in the locking link 230 and a hole 244 formed in the guiding link 202. This second spring 242 exerts a biasing force on the locking link 230 urging the front end 233 of the locking link 230 downwardly so that the hook 236 engages a bolt 246 extending through the footrest support bar 30. As illustrated in FIG. 9A, the footrest support bar 30 has a cut-out portion adapted to receive the front end 233 of the locking link 230.

As illustrated in FIGS. 9A and 9B, a cable 250 is secured to the locking link 230 and extends forwardly through the groove 210 formed in the lip 208 of the guiding link 230. In operation, when a seat occupant causes the cable 250 to move forwardly, the locking link 230 rotates in a counterclockwise direction about the pivot connection 232 against the force of the second spring 242 from a first position illustrated in FIG. 9A to a second position illustrated in FIG. 9B, thus raising the hook 236 out of engagement with the bolt 246. With the hook 236 raised above the bolt 246, the biasing force of the first spring 220 causes the pushing link 214 to rotate counterclockwise about pivot 206 from a first position illustrated in FIG. 9A to a second position illustrated in FIG. 9B. The lower end 226 of the pushing link 214 pushes the footrest support bar 30 from its retracted position shown in FIG. 9A forwardly toward its extended position, in the direction of arrow 252. In this manner, a seat occupant can urge the footrest support bar forwardly.

While the present invention has been illustrated by a description of a preferred embodiment and while this embodiment have been described in considerable detail in order to describe the best mode of practicing the invention, it is not the intention of applicant to restrict or in any way limit the scope of the appended claims to such detail. As some examples, the various linkage configurations, connections, etc., may differ significantly from mechanism to mechanism. A connection between two elements need not be a direct connection but may be a connection made through other structure. Also, with respect to the S-shaped section of the footrest support bar or the contemplated S-shaped track, although the preferred support bar is shown with an overall gradual, continuously curving S-shape, this term is meant to include other generally S-shaped configurations, including those having straight end portions, for example, or other curving portions. In combination with the curved track, the disclosed configuration is deemed to provide a desirable footrest movement. The configuration also functions well if the track is generally straightened except for a downwardly curved front end portion. Other combinations of curved track and support bar sections, for example, in combination with a linkage assembly may work as well while retaining the general inventive apparatus and method. Additional advantages and modifications within the spirit and scope of the invention will readily appear to those skilled in the art. The invention itself should only be defined by the appended claims, wherein it is claimed:

What is claimed is:

1. A reclining mechanism for a furniture item to allow movement of the furniture item between upright and reclined positions, the reclining mechanism comprising:

support structure adapted for attachment to the furniture item, a footrest support bar connected for longitudinal movement with respect to the support structure between extended and retracted positions, the footrest support bar having an S-shaped section located between first and second ends, said first end adapted for connection to a footrest member for supporting legs of a seat occupant, a pusher assembly adapted to urge said footrest support bar towards said extended position from said retracted position.

2. The reclining mechanism of claim 1, wherein the footrest support bar includes at least one roller attached for rotation thereto and the support structure further includes a track, said roller being mounted for movement along said track between the extended and retracted positions.

3. The reclining mechanism of claim 2, wherein said track includes first and second ends and at least one curved section between the first and second ends.

4. The reclining mechanism of claim 3, wherein the curved section of said track curves upward and then downward from a rear portion to a front portion thereof.

5. The reclining mechanism of claim 2 further comprising an actuating structure connected with the footrest support bar in a manner allowing said actuating structure to travel along said track as the footrest support bar moves between the extended and retracted positions.

6. The reclining mechanism of claim 5, wherein the roller is further connected for movement with said actuating structure along said track.

7. The reclining mechanism of claim 2, wherein the roller is attached proximate the second end of said footrest support bar.

8. The reclining mechanism of claim 7, wherein the track includes first and second stops and said roller engages said stops at the respective upright and reclined positions.

9. The reclining mechanism of claim 2 further comprising at least a second roller connected with the support structure adjacent said footrest support bar, said second roller engaging the footrest support bar during movement between the extended and retracted positions.

10. The reclining mechanism of claim 2 further comprising upper and lower rollers connected with the support structure adjacent the footrest support bar, said upper and lower rollers supporting and guiding said footrest support bar during movement between the extended and retracted positions.

11. The reclining mechanism of claim 1, wherein said pusher assembly is secured to said support structure.

12. A three way reclining mechanism for moving an item of furniture between upright, intermediate reclined and fully reclined positions, the mechanism comprising:

a base member, seat supporting linkage, backrest linkage connected to a rear end of said seat supporting linkage and including a pivoting backrest link for attachment to a backrest and operable to pivot with respect to said seat supporting linkage, an S-shaped footrest support bar connected to a forward end of said seat supporting linkage to allow extension and retraction of said footrest support bar, actuating structure connected with said S-shaped footrest support bar for moving the S-shaped footrest support bar between extended and retracted positions as said mechanism moves between the upright position and the intermediate reclined position, and a pusher assembly adapted to urge said footrest support bar towards said extended position from said retracted position.

13. The reclining mechanism of claim 12, wherein the footrest support bar includes at least one roller attached for rotation thereto and the seat supporting linkage includes a track, said roller being mounted for movement along said track between the extended and retracted positions.

14. The reclining mechanism of claim 13, wherein said track includes first and second ends and at least one curved section between the first and second ends.

15. The reclining mechanism of claim 14, wherein the curved section of said track curves upward and then downward from a rear portion to a front portion thereof.

16. The reclining mechanism of claim 13, wherein the seat supporting linkage is mounted adjacent the footrest support bar in a manner allowing said actuating structure to travel along said track as the footrest support bar moves between the extended and retracted positions.

17. The reclining mechanism of claim 13, wherein the roller is attached proximate to an end of the footrest support bar.

18. The reclining mechanism of claim 17, wherein the track includes first and second stops and said roller engages said stops at the respective upright and reclined positions.

19. The reclining mechanism of claim 13, wherein the roller is further connected with said actuating structure for movement by said actuating structure along said track.

20. The reclining mechanism of claim 13 further comprising at least a second roller connected with the seat supporting linkage adjacent said footrest support bar, said second roller engaging the footrest support bar during movement between the extended and retracted positions.

21. The reclining mechanism of claim 13 further comprising upper and lower rollers connected with the seat supporting linkage adjacent the footrest support bar, said upper and lower rollers supporting and guiding the footrest support bar during movement between the extended and retracted positions.

22. The reclining mechanism of claim 12, wherein said pusher assembly includes a spring biased pusher link abutting said footrest support bar.

23. A reclining mechanism for a furniture item to allow movement of the furniture item between upright and reclined positions, the reclining mechanism comprising:

support structure adapted for attachment to the furniture item, a track connected with the support structure, a footrest support bar connected with said track for longitudinal movement with respect to the support structure between extended and retracted positions, at least one of said track and said footrest support bar having an S-shaped section, actuating structure connected with said footrest support bar and operable to move said footrest support bar along said S-shaped section between said extended and retracted positions, and a pusher assembly adapted to urge said footrest support bar towards said extended position from said retracted position.

24. A reclining furniture item movable between upright, intermediate reclined and fully reclined positions, the furniture item comprising:

a base member;

a backrest, a seat and a footrest connected for movement with respect to said base member by a pair of reclining mechanisms, each reclining mechanism including:

i) seat supporting linkage including a seat link connected to said seat, ii) backrest linkage connected to a rear end of said seat supporting linkage and including a pivoting backrest link connected to said backrest and operable to allow pivoting of said backrest with respect to said seat, iii) a track connected with said seat link, iv) a footrest support bar connected to a forward end of said seat support linkage and connected with said footrest to allow extension and retraction of said footrest when moving between the upright position and the intermediate reclined position, at least one of said track and said footrest support bar having an S-shaped section, v) actuating structure connected with said footrest support bar for moving the footrest support bar between extended and retracted positions as said furniture item moves between the upright position and the intermediate reclined position, and vi) a pusher assembly adapted to urge said footrest support bar towards said extended position from said retracted position.

25. The reclining furniture item of claim 24, wherein the pusher assembly comprises:

a spring-biased locking link adapted to engage said footrest support bar, and maintain said footrest support bar in said retracted position, and a spring-biased pushing link adapted to push said footrest support bar forwardly.

26. A reclining mechanism foe a furniture item to allow movement of the furniture item between upright and reclined positions, the reclining mechanism comprising:

support structure adapted for attachment to the furniture item, a footrest support bar connected for longitudinal movement with respect to the support structure between extended and retracted positions, the footrest support bar having an S-shaped section located between first and second ends, said first end adapted for connection to a footrest member for supporting legs of a seat occupant, a pusher assembly adapted to urge said footrest support bar towards said extended position from said retracted position, said pusher assembly comprising:

a spring-biased locking link adapted to engage said footrest support bar, and maintain said footrest support bar in said retracted position, and a spring-biased pushing link adapted to push said footrest support bar forwardly.

* * * * *